US005292611A

United States Patent [19]

Ohbayashi et al.

[11] Patent Number: 5,292,611

[45] Date of Patent: Mar. 8, 1994

[54] DYE IMAGE FORMING METHOD

[75] Inventors: Keiji Ohbayashi; Masaru Tsuchiya; Kazuhiro Miyazawa, all of Hino, Japan

[73] Assignee: Konica Corporation, Tokyo, Japan

[21] Appl. No.: 984,866

[22] Filed: Dec. 1, 1992

[30] Foreign Application Priority Data

Dec. 17, 1991 [JP] Japan ..... 3-333519

[51] Int. Cl.[5] ..... G03C 5/54; G03C 1/34

[52] U.S. Cl. ..... 430/203; 430/219; 430/607; 430/614; 430/615; 430/617

[58] Field of Search ..... 430/203, 219, 607, 614, 430/617, 619, 615, 216

[56] References Cited

U.S. PATENT DOCUMENTS

| | | | |
|---|---|---|---|
| 2,592,250 | 4/1952 | Davey et al. . | |
| 3,220,613 | 4/1964 | Palmer et al. . | |
| 3,271,257 | 10/1963 | Averette, Jr. . | |
| 3,317,322 | 5/1967 | Porter et al. . | |
| 3,342,599 | 6/1965 | Reeves . | |
| 3,347,675 | 10/1967 | Henn et al. . | |
| 3,438,776 | 4/1969 | Yudelson . | |
| 3,447,927 | 6/1969 | Bacon et al. . | |
| 3,531,291 | 9/1970 | Bacon . | |
| 3,645,739 | 2/1972 | Ohkubo et al. . | |
| 3,666,477 | 5/1972 | Goffe . | |
| 3,667,959 | 6/1972 | Bojara et al. . | |
| 3,700,457 | 10/1972 | Youngquist . | |
| 3,703,584 | 11/1972 | Motter . | |
| 3,709,690 | 1/1973 | Cohen et al. . | |
| 3,719,492 | 3/1973 | Barr et al. . | |
| 3,736,140 | 5/1973 | Collier et al. . | |
| 3,761,266 | 9/1973 | Milton . | |
| 3,761,270 | 9/1973 | de Mauriac et al. . | |
| 3,761,276 | 9/1973 | Evans . | |
| 3,764,328 | 10/1973 | Birkeland . | |
| 3,794,496 | 2/1974 | Manhardt . | |
| 4,123,274 | 10/1978 | Knight et al. . | |
| 4,137,079 | 1/1979 | Houle . | |
| 4,138,265 | 2/1979 | Shiao . | |
| 4,235,957 | 11/1980 | Kohrt et al. . | |
| 4,439,513 | 3/1984 | Sato et al. . | |
| 4,463,079 | 7/1984 | Naito et al. . | |
| 4,626,499 | 12/1986 | Kato et al. | 430/203 |
| 5,051,348 | 9/1991 | Taguchi et al. | 430/203 |
| 5,079,137 | 1/1992 | Taguchi et al. | 430/203 |
| 5,116,716 | 5/1992 | Komamura et al. | 430/203 |

FOREIGN PATENT DOCUMENTS

| | | |
|---|---|---|
| 0159725 | 10/1985 | European Pat. Off. . |
| 0269291 | 6/1988 | European Pat. Off. . |
| 1-283558 | 11/1989 | Japan . |

OTHER PUBLICATIONS

Patents Abstracts of Japan, vol. 10, No. 271 (p-497) (2327) Sep. 16, 1986 & JP-A-61 093 451 (Fuji) May 12, 1986, abstract.

*Primary Examiner*—Richard L. Schilling

*Attorney, Agent, or Firm*—Frishauf, Holtz, Goodman & Woodward, P.C.

[57] ABSTRACT

A method for forming a dye image with high contrast is provided, wherein a heat-processable light-sensitive material comprising a support having thereon a non-light-sensitive layer and a light-sensitive layer containing a light-sensitive silver halide and a dye-providing material capable of releasing or forming a diffusible dye upon heat development is subjected to heat development to release or form the diffusible dye, which is transferred to a dye-receiving material having a dye-receiving layer to form a dye image on the dye-receiving layer, wherein the heat development or the transfer of the dye is carried out in the presence of a compounds represented by formula 1 or 2 and a compound represented by formula 3 or 4, $(X_1)_r—Q$ formula 1 formula 1:

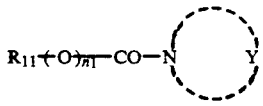

$R_{31}—X_2$ formula 3

$R_{41}—CO—Y_1—W.$ formula 4

5 Claims, No Drawings

DYE IMAGE FORMING METHOD

FIELD OF THE INVENTION

The present invention relates to a dye image forming method using a silver halide photographic light-sensitive material, more specifically a dye image forming method for forming a transfer image with high contrast.

BACKGROUND OF THE INVENTION

Heat development, in which the developing process is conducted under heating conditions, is a well-known technique; as a means of obtaining a color image, the so-called the transfer type heat-processable light-sensitive material, in which a dye image is transferred from the light-sensitive material to the image-receiving layer, is also known well.

To suppress fogging occurring in the heat developing process, many antifogging techniques for heat-processable light-sensitive materials and dye-receiving materials have been disclosed. However, almost all of such techniques have drawbacks, including those related to storage quality such as storage stability deterioration in the heat-processable light-sensitive material and dye-receiving material and degradation of the antifogging effect during storage, and sensitivity reduction, great reduction of contrast, maximum density reduction, heat processablity and dye transferability reduction and unstable production of the heat-processable light-sensitive material.

Another problem in heat development at high temperature is that chemical sensitization must be completed at a point fairly lower than the maximum sensitivity to be reached because even the formation of a very small number of fogging nuclei results in increased $D_{min}$ in chemically sensitizing the grain surface of silver halide photographic emulsion. However, when the degree of chemical sensitization is lowered to have sufficiently low fogging, not only is the sensitivity lowered but also the heat-processable light-sensitive material contrast is lowered. In addition, the silver halide emulsion subjected to such limited chemical sensitization was found to easily undergo considerable contrast reduction on the shoulder (high density region) on the characteristic curve in short-time exposure because luminance intensity increases.

For this reason, it is preferable to be as close to the maximum sensitivity as possible in chemical sensitization of the grain surface of silver halide emulsion, but it has been difficult to reach a sufficient level because of a rise in $D_{min}$.

In this situation, there has been a demand for an antifogging technology wherein the maximum density is hardly affected, fogging is effectively suppressed, photographic performance is hardly affected and a heat-processable light-sensitive material is stably produced and coating solution retention is good.

Japanese Patent Publication Open to Public Inspection (hereinafter referred to as Japanese Patent O.P.I. Publication) Nos. 118155/1988 and 144350/1988 disclose a heat-processable light-sensitive material and a dye-receiving material wherein $D_{min}$ is lowered with almost no effect on $D_{max}$ by the addition of particular compounds substituted by a halogen atom. However, this method was found faulty in that these compounds decompose partially and the antifogging effect is slightly degraded when the heat-processable light-sensitive material or dye-receiving material is stored for a long time, particularly under high moisture conditions, though they offer excellent improvement in $D_{max}/D_{min}$. Also it was found that in producing a heat-processable light-sensitive material or dye-receiving material containing such compounds, the coating solution containing them, if retained for a long time, tend to lower the antifogging effect. In addition, these compounds are insufficient to enhance contrast on the characteristic curve, though they are sufficiently suppress fogging.

Japanese Patent O.P.I. Publication No. 223852/1991 discloses a heat-processable light-sensitive material and dye-receiving material containing a compound which reacts with anisidine at a particular reaction rate, and describes that the use of such a compound provides a heat-processable light-sensitive material with suppressed stain and desensitization due to fogging and suppressed increase in aging stain in the transferred image.

However, even when such a compound is added to the heat-processable light-sensitive material or dye-receiving material, the antifogging effect in the heat-processable light-sensitive material is insufficient, and when such a compound is added to the heat-processable light-sensitive material, fogging occurring during light-sensitive material storage is not sufficiently suppressed.

SUMMARY OF THE INVENTION

With the aim of solving these problems, the object of the present invention is to provide a dye image forming method wherein the maximum density hardly lowers and fogging does not increase even when the coating solution is stored for a long time in producing a heat-processable light-sensitive material or dye-receiving material, or even when the heat-processable light-sensitive material or dye-receiving material is stored under high humid conditions for a long time, and a transferred dye image with markedly increased contrast is obtained by heat development.

The above object of the invention is accomplished by a dye image forming method wherein a heat-processable light-sensitive material comprising a support and at least one light-sensitive layer containing a binder, a light-sensitive silver halide and a dye-providing material which releases or forms a diffusible dye upon heat development formed thereon is subjected to heat development to form or release the diffusible dye, which is diffusively transferred to a dye-receiving material to form a dye image on the image-receiving layer, wherein heat development and/or diffusive transfer is carried out in the presence of at least one kind of the compounds represented by the following formula 1 or 2 and at least one kind of the compound represented by the following formula 3 or 4.

Formula 1:

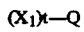

Formula 2:

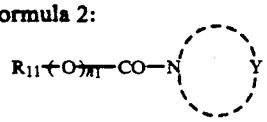

Formula 3:

Formula 4:

$R_{41}$—CO—$Y_1$—W wherein $X_1$ represents a chlorine atom, a bromine atom or an iodine atom; Q represents

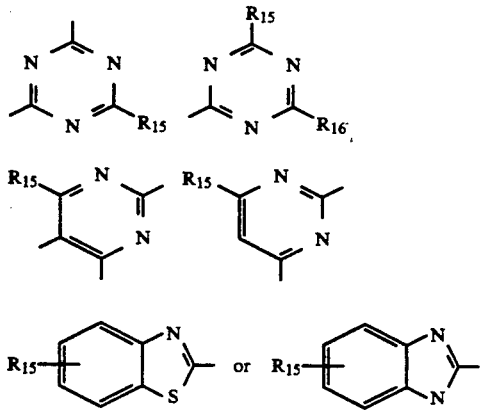

$R_{15}$ represents a monovalent organic group; $R_{16}$ represents a hydrogen atom or a monovalent organic group; t represents 1, 2 or 3, and provided that t is 2 or 3, the $X_1$ atoms may be identical or different; $R_{15}$ and $R_{16}$ may be a polymer residue; $R_{11}$ represents an alkyl group, an alkenyl group, an aryl group or a heterocyclic group; Y represents a group of atoms necessary to form a nitrogen-containing heterocycle selected so that a compound represented by

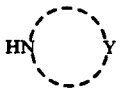

has a pKa value of not more than 8.

$n_1$ represents 0 or 1.

$R_{31}$ represents an alkyl group or a cycloalkyl group.

$X_2$ represents a bromine atom or an iodine atom.

$R_{41}$ represents an alkyl group, an alkoxy group, an aryl group, an aryloxy group or a heterocyclic group; W represents a phenyl group substituted for by at least one halogen atom, alkoxy group, phenoxy group, sulfonyl group, acyl group or cyano group.

$Y_1$ represents an oxygen atom or a sulfur atom.

DETAILED DESCRIPTION OF THE INVENTION

The dye image forming method of the present invention is hereinafter described in detail.

With respect to formula 1, the monovalent organic group $R_{15}$ in the group represented by Q is exemplified by an alkyl group, an alkenyl group, an alkoxy group, an aryl group, an aryloxy group, an alkylamino group, an arylamino group, an acylamino group, a sulfonamide group, an ureide group, a carboxyl group, an alkoxycarbonyloxy group or an allyloxycarbonyl group. These groups may have an additional substituent.

Provided that $R_{16}$ is a monovalent organic group other than a hydrogen atom, the organic residue for $R_{15}$ may be used as such an organic group.

$R_{15}$ and $R_{16}$ may be a polymer residue. Provided that neither $R_{15}$ nor $R_{16}$ is a polymer residue, the total number of carbon atoms contained in $R_{15}$ and $R_{16}$ is preferably not less than 4, more preferably not less than 8.

With respect to formula 1, the group represented by Q is preferably

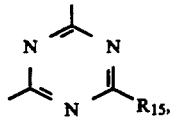

wherein $X_1$ is preferably a chlorine atom.

Examples of the compound represented by formula 1 are given below.

1-1

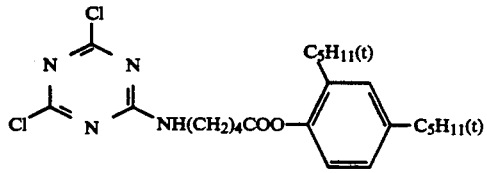

1-2

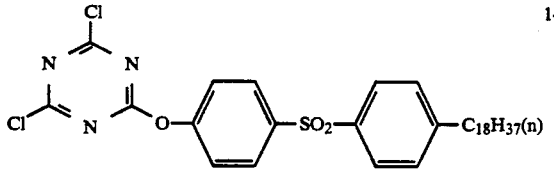

1-3

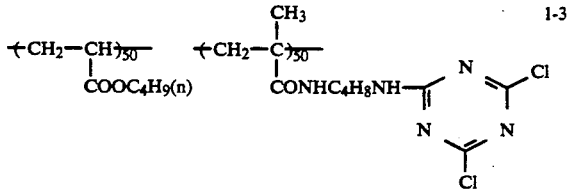

In addition to the above compounds, T-1 through T-19, T-22 and T-23 listed in Table 1 of Japanese Patent O.P.I. Publication No. 11815/1988 and polymer compounds PT-1 through PT-13 listed in Table 3 of the same publication can also be used for the present invention.

These compounds can easily be synthesized in accordance with the methods described in the above references.

With respect to the compound represented by formula 2, the alkyl group or alkenyl group represented by $R_{11}$ may be linear, branched or cyclic, and is preferably an alkyl group or alkenyl group having 4 to 30 carbon atoms. The aryl group is preferably a phenyl group or a naphthyl group. Five- or Six-membered heterocyclic groups containing oxygen, sulfur or nitrogen as a hetero atom are preferably used. The alkyl group, alkenyl group, aryl group and heterocyclic group represented by $R_{11}$ may each have an additional substituent.

With respect to formula 2, Y represents a group of atoms selected so that the pKa value of

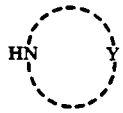

at 25° C. is not more than 8, preferably in the range of 2 to 7, wherein pKa relates to the acidity in aqueous solutions and is defined as follows:

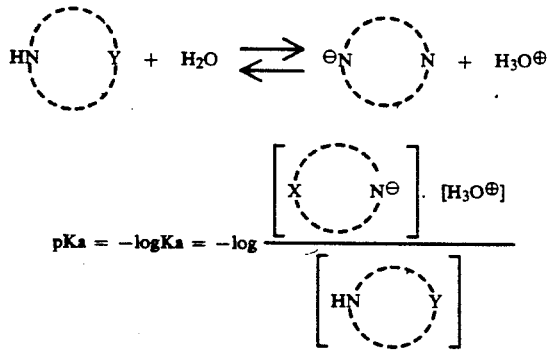

pKa can be calculated by preparing a solution of the subject compound of known concentration and titrating it with a 1N sodium hydroxide solution to determine the pH corresponding to the turning point on the titration curve.

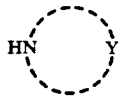

may cooperate with another carbon ring or heterocycle to form a condensed ring and may have a substituent.

Said substituent may have as a substituent an alkyl group, an aryl group, an alkoxy group, an aryloxy group, an amino group, an alkylthio group, an arylthio group, an alkylsulfonyl group, an arylsulfonyl group, an alkoxycarbonyl group, an aryloxycarbonyl group, a carboxyl group, an alkylamino group, an arylamino group, an acyl group, an acylamino group, a sulfonylamino group, a hydroxyl group, a cyano group, a halogen atom or a nitro group.

With respect to formula 2, the total number of carbon atoms contained in $R_{11}$ and

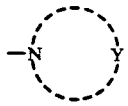

is preferably not less than 8, more preferably not less than 12.

Also, the substituent in $R_{11}$ or

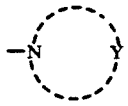

may be a polymer residue.

Example compounds represented by

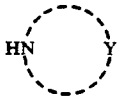

having a pKa value of not more than 8 are given below.

| | | pKa |
|---|---|---|
| N-1 | 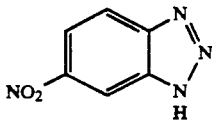 | 6.5 |
| N-2 | 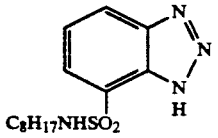 | 7.4 |
| N-3 | 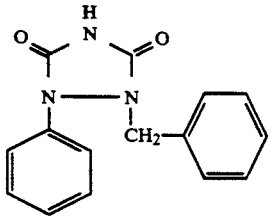 | 7.9 |
| N-4 | 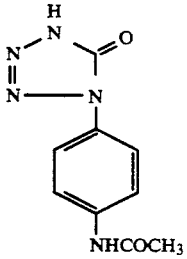 | 6.0 |
| N-5 | 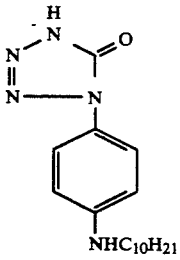 | 6.0 |
| N-6 | 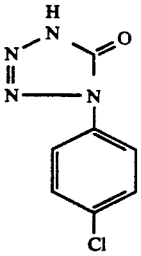 | 5.75 |
| N-7 | 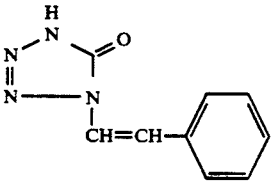 | 5.8 |

-continued

N-8

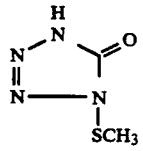

6.1

N-9

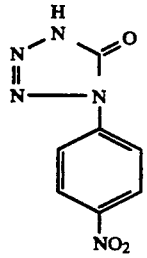

5.3

N-10

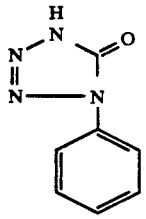

6.2

N-11

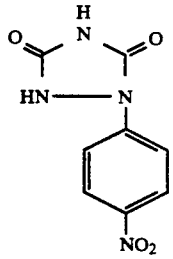

4.9

N-12

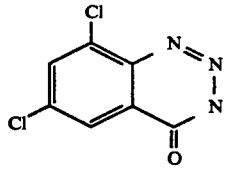

7.65

N-13

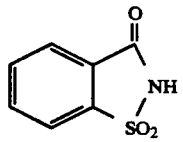

2.6

N-14

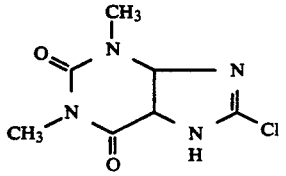

5.6

-continued

N-15

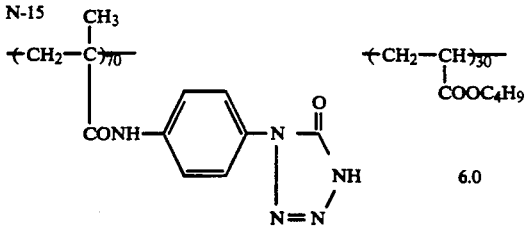

6.0

(In N-15, "70, 30" shows the ratio by weight.)

2-1

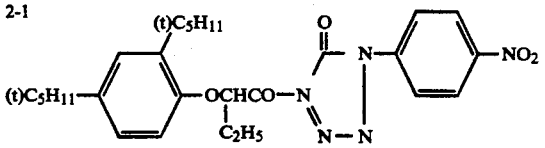

2-2

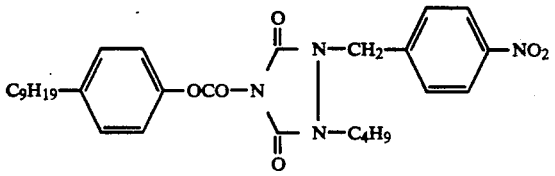

In addition to these compounds, T-1 through T-9 and T-11 through T-30 listed on page 5 of Japanese Patent O.P.I. Publication No. 283558/1989 can also be used as the compound represented by formula 2. These compounds represented by formula 2 can easily be synthesized, for example, by reaction of $R_{11}(O)n_1COC_1$ and

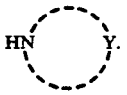

With respect to formula 3, the alkyl group represented by $R_{31}$ is preferably an alkyl group having 6 to 20 carbon atoms, and may have a substituent. Example substituents include an alkoxy group, an aryl group, an acyloxy group, an aryloxy group, a halogen atom such as an atom of chlorine, bromine or iodine, an acylamino group, an alkoxycarbonyl group, a hydroxyl group, a sulfonylamino group, a carbamoyl group and a sulfamoyl group.

$X_2$ represents a bromine atom or an iodine atom, preferably an iodine atom.

The molecular weight of the halide compound represented by formula 3 is preferably not less than 150, more preferably not less than 200 from the viewpoint of stability in the heat-processable light-sensitive material or dye-receiving material.

Examples of the compound represented by formula 3 are given below.

3-1 $C_{20}H_{41}Br$ 3-2 $C_{10}H_{21}Br$ 3-3 $C_{10}H_{21}I$ 3-4 $C_{16}H_{33}Br$ 3-5 $C_{16}H_{33}I$ 3-6 $C_{18}H_{37}Br$

-continued 3-7 $C_{18}H_{37}I$ 3-8 $C_{10}H_{21}I$ 3-9 $C_{20}H_{41}I$ 3-10

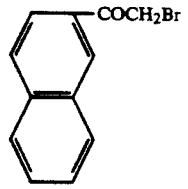

3-11

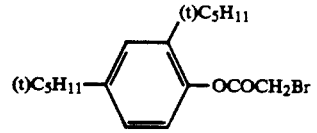

3-12

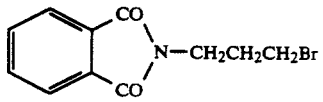

3-13

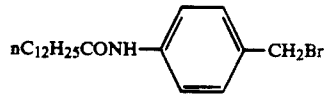

3-14

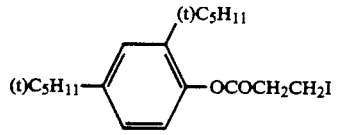

3-15 $Br(CH_2)_{10}Br$ 3-16 $Br(CH_2)_{12}Br$ 3-17 $BrCH_2CH_2COO(CH_2)_4OCOCH_2CH_2Br$ 3-18

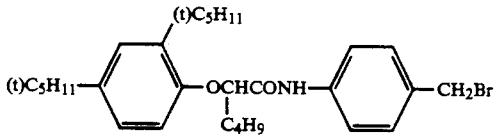

3-19

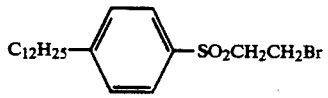

With respect to formula 4, the alkyl group represented by $R_{41}$ is preferably an alkyl group having 1 to 20 carbon atoms, and may have a substituent such as a halogen atom, an aryl group, an aryloxy group, a heterocyclic group, a hydroxyl group, an acyl group, a carbamoyl group, a sulfo group, a sulfonyl group, an alkoxycarbonyl group, a sulfonamide group or a carboxyl group.

The alkoxy group represented by $R_{41}$ is preferably an alkoxy group having 1 to 20 carbon atoms, and may have a substituent such as a halogen atom, an aryl group, an aryloxy group, a heterocyclic group, a hydroxyl group, an acyl group, a carbamoyl group, a sulfo group, a sulfonyl group, an alkoxycarbonyl group, a sulfonamide group or a carboxyl group.

The aryl group represented by $R_{41}$ is preferably a phenyl group or a naphthyl group, and may have a substituent such as a halogen atom, an alkyl group, an alkoxy group, an aryl group, an aryloxy group, a heterocyclic group, a hydroxyl group, an acyl group, a carbamoyl group, a sulfo group, a sulfonyl group, an alkoxycarbonyl group, a sulfonamide group or a carboxyl group.

The aryloxy group represented by $R_{41}$ is preferably a phenoxy group or a naphthoxy group, and may have a substituent such as a halogen atom, an alkyl group, an alkoxy group, an aryl group, an aryloxy group, a heterocyclic group, a hydroxyl group, an acyl group, a carbamoyl group, a sulfo group, a sulfonyl group, an alkoxycarbonyl group, a sulfonamide group or a carboxyl group.

The heterocyclic group represented by $R_{41}$ is preferably a homocycle or condensed ring having 5 to 10 carbon atoms, and may have a substituent such as a halogen atom, an alkyl group, an alkoxy group, an aryl group, an aryloxy group, a heterocyclic group, a hydroxyl group, an acyl group, a carbamoyl group, a sulfo group, a sulfonyl group, an alkoxycarbonyl group, a sulfonamide group or a carboxyl group.

With respect to formula 4, W represents a phenyl group substituted by at least one halogen atom, alkoxy group, phenoxy group, sulfonyl group, acyl group or cyano group, with preference given to a phenyl group substituted for by at least one halogen atom or sulfonyl group, more preferably a phenyl group having two or more substituents of halogen atoms. Said halogen atom is preferably a chlorine atom or a bromine atom, preferably a chlorine atom.

Examples of the compound of the present invention represented by formula 4 are given below.

4-1

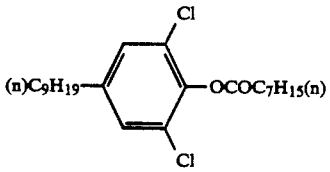

4-2

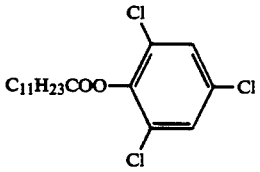

4-3

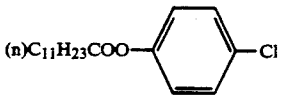

4-4

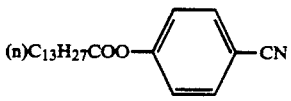

-continued 4-5

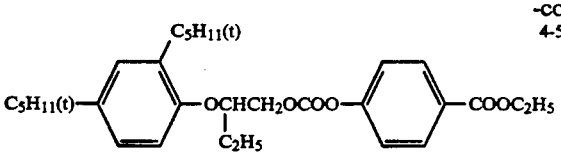

4-6

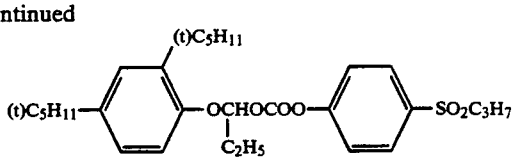

4-7

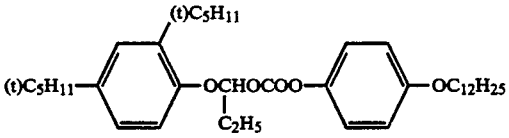

4-8

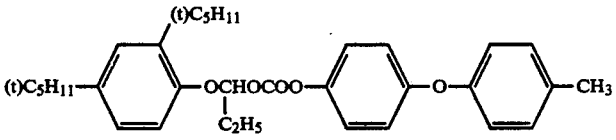

4-9

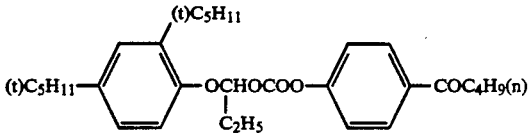

4-10

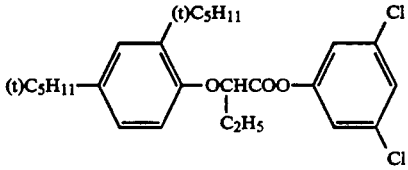

4-11

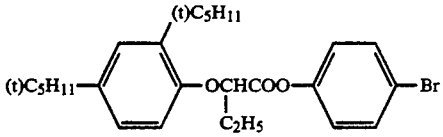

4-12

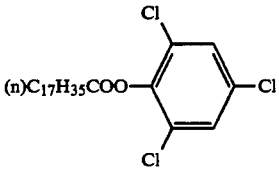

4-13

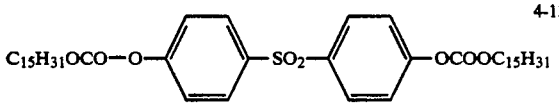

4-14

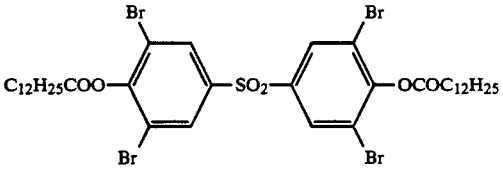

4-15

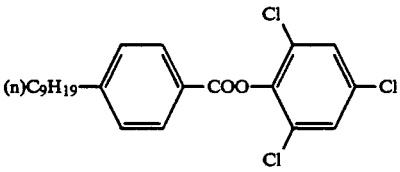

4-16

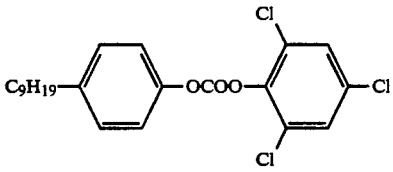

4-17

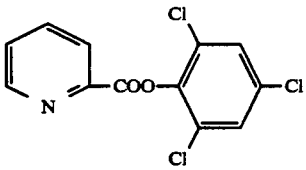

In addition to these compounds, I-9, I-10, I-11, I-23, I-54 through I-69, I-72 through I-117 and I-119 through I-126 listed on pages 6 through 20 of Japanese Patent Examined Publication No. 32058/1991 can also be used as the compound represented by formula 4.

Some of these compounds, represented by formulas 3 and 4, are commercially available, and can easily be synthesized, for example, in accordance with the method described in Japanese Patent Examined Publication No. 32058/1991.

The compounds of formulas 1 through 4 above are added to heat-processable light-sensitive material and/or dye-receiving material.

When a compound of the present invention is added to a heat-processable light-sensitive material, it can be added to any of light-sensitive layer, intermediate layer, protective layer and subbing layer, but when adding the compound represented by formula 1 or 2 to the heat-processable light-sensitive material, it is preferable to add it to a non-light-sensitive layer such as an intermediate layer, a subbing layer or a protective layer. When adding the compound represented by formula 3 or 4, it is preferable to add it to a light-sensitive layer, since the effect of the present invention is enhanced.

On the other hand, when adding a compound of the present invention to a dye-receiving material, it can be added to the image-receiving layer or a layer adjacent thereto, but it is preferable to add it to the image-receiving layer.

Also, the compound represented by formula 1 or 2, and the compound represented by formula 3 or 4 can be added in various combinations to the heat-processable light-sensitive material and dye-receiving material. Specifically, the following combinations are possible.

In the table below, F and F' represent the compound represented by formula 1 or 2, and S and S' represent the compound represented by formula 3 or 4.

| | Heat-processable light-sensitive material | | Dye-receiving material | |
|---|---|---|---|---|
| 1 | F | S | | |
| 2 | F | | | S' |
| 3 | | S | F' | |
| 4 | | | F' | S' |
| 5 | F | S | F' | |
| 6 | F | | F' | S' |
| 7 | F | S | | S' |
| 8 | | S | F' | S' |
| 9 | F | S | F' | S' |

Concerning this list, the compounds represented by F and F', and S and S' may be used singly or in combination of two kinds.

Each of the compounds represented by formulas 1 through 4 is used at 0.01 to 10 g, preferably 0.05 to 2 g per $m^2$ of heat-processable light-sensitive material or dye-receiving material. The preferred ratio of the compound represented by formula 3 or 4 to the compound represented by formula 1 or 2 varies depending on the target layer, and falls in the range of about 0.02 to 50 by weight, preferably 0.05 to 20 by weight, and ideally 0.1 to 10 by weight.

The compounds of the present invention are generally hydrophobic, and are added to heat-processable light-sensitive material and dye-receiving material by known methods. Specifically, they are added in emulsion dispersion or solid microdispersion in a hydrophilic binder by an appropriate method or in solution in an organic solvent in a hydrophobic binder.

The heat-processable light-sensitive material of the present invention is described below.

The heat-processable light-sensitive material of the present invention comprises a support and at least one light-sensitive layer formed thereon, which light-sensitive layer contains both a light-sensitive silver halide and a dye-providing material which releases or forms a diffusible dye upon heat development, and preferably comprises three or more light-sensitive layers which form or release yellow, magenta and cyan diffusible dyes, and it is preferable from the viewpoint of prevention of color mixing that an intermediate layer be present between light-sensitive layers which form or release dyes with different hues.

Any known conventional light-sensitive silver halide can be used in the heat-processable light-sensitive material of the present invention, including silver chloride, silver bromide, silver iodobromide, silver chlorobromide and silver chloroiodobromide.

The silver halide may have a structure wherein the composition is uniform from the inside to the surface of grains or the composition changes continuously or step by step from the inside to the surface.

The silver halide may or may not have a clear crystal habit. It may be a tabular, cubic, spherical, octahedral, dodecahedral or tetradecahedral crystal.

Internal latent image type silver halide emulsions such as those described in U.S. Pat. Nos. 2,592,250, 3,220,613, 3,271,257, 3,317,322, 3,511,622, 3,531,291, 3,447,927, 3,761,266, 3,703,584, 3,736,140 and 3,761,276 and Japanese Patent O.P.I. Publication Nos. 15661/1977 and 127549/1980 can also be used.

The light-sensitive silver halide may be supplemented with a metal ion species such as of iridium, gold, rhodium, iron or zinc in the form of an appropriate salt at the stage of forming grains thereof.

The grain size of the light-sensitive silver halide emulsion is about 0.02 to 2 μm, preferably about 0.05 to 0.5 μm.

In the present invention, a light-sensitive silver halide can also be prepared by partially converting an organic silver salt as described below to the light-sensitive silver halide, wherein the organic salt is allowed to exist with a light-sensitive silver salt forming component such as a water-soluble halide.

The light-sensitive silver halide emulsion can be subjected to chemical sensitization of the silver halide grain surface with known sensitizers such as active gelatin, elemental sulfur, sodium thiosulfate, thiourea dioxide and sodium chloroaurate, and can also be chemically sensitized in the presence of a nitrogen-containing heterocyclic compound or a mercapto-containing heterocyclic compound.

The light-sensitive silver halide can also be spectrally sensitized in the blue, green, red and near infrared spectra with spectral sensitizing dyes used in ordinary photography such as known cyanine and merocyanine dyes.

These sensitizing dyes can be added at 1 μmol to 1 mol, preferably 10 μmol to 0.1 mol per mol of silver halide at any time at formation of silver halide grains, at removal of soluble salts, before initiation of chemical sensitization, at chemical sensitization or after completion of chemical sensitization.

Dye-providing materials which can be used in the heat-processable light-sensitive material of the present invention include diffusible-dye-forming couplers such as those described in Japanese Patent O.P.I. Publication Nos. 61157/1986, 61158/1986, 44738/1987, 129850/1987, 129851/1987, 129852/1987 and 169158/1987 and Japanese Patent Application No. 200859/1989, leuco dyes such as those described in Japanese Patent O.P.I. Publication No. 88254/1986, azo dyes such as those described in U.S. Pat. No. 4,235,957., and those described in U.S. Pat. Nos. 4,463,079 and 4,439,513 and Japanese Patent O.P.I. Publication Nos. 0434/1984, 65389/1984, 71046/1984, 87450/1984, 123837/1984, 24329/1984, 165054/1984 and 165055/1984. Compounds which form a diffusible dye upon coupling reaction are preferred, including the compound represented by formula b on line 2, lower left column, page 9 of Japanese Patent O.P.I. Publication No. 863/1990.

The polymer coupler described on line 8, lower right column, page 9 of the same publication, which has a polymer chain having a repeat unit derived from the monomer represented by formula b, is preferred.

Example positive dye-providing materials include the compounds described in Japanese Patent O.P.I. Publication Nos. 5430/1984, 165054/1984, 154445/1984, 116655/1984, 24327/1984, 152440/1984 and 13546/1989.

These dye-providing materials may be used singly or in combination. In the present invention, the polymer UV agent for the present invention may be contained in the same layer as with the dye-providing materials. In this case, the dye-providing material and the polymer UV agent of the present invention of the present invention may be dispersed simultaneously.

The heat-processable light-sensitive material of the present invention is also applicable to the type wherein an image is formed by encapsuling and thermally processing a dye-providing material, together with a polymerizable compound such as that described in Japanese Patent O.P.I. Publication No. 293753/1990 or 308162/1990, in microcapsules to cause imagewise or reverse-imagewise polymerization of the polymerizable compound to harden the microcapsules and alter the diffusibility of the dye-providing material to the image-receiving layer.

The heat-processable light-sensitive material of the present invention can incorporate known organic silver salts for the purpose of improving sensitivity or developability.

Example organic silver salts which can be used for the present invention include the silver salts of long-chain aliphatic carboxylic acid described in Japanese Patent Examined Publication No. 4921/1968, Japanese Patent O.P.I. Publication Nos. 52626/1984, 141222/1977, 36244/1978, 37626/1978, 36224/1978 and 37610/1978 and U.S. Pat. Nos. 3,330,633, 3,794,496 and 4,105,451, and silver salts of hetero-ring-containing carboxylic acid such as silver behenate and silver α-(1-phenyltetrazolethio)acetate, the silver salts of imino-group-containing compound described in Japanese Patent Examined Publication Nos. 26582/1969, 12700/1970, 18416/1970 and 22815/1970, Japanese Patent O.P.I. Publication Nos. 137321/1977, 118638/1983 and 118639/1983 and U.S. Pat. No. 4,123,274, and the acetylene silver described in Japanese Patent O.P.I. Publication No. 249044/1986.

Silver salts of imino-group-containing compound are preferred, with greater preference given to silver salts of benzotriazole or derivatives thereof, such as benzotriazole silver and 5-methylbenzotriazole silver.

The heat-processable light-sensitive material of the present invention preferably incorporates a reducing agent. A preferably used reducing agent is selected from the group comprising conventional ones for heat-processable light-sensitive materials based on developing mechanism or dye forming or releasing mechanism. The reducing agents mentioned herein include reducing agent precursors which release a reducing agent upon heat development.

Example reducing agents which can be used include the developing agents based on p-phenylenediamine or p-aminophenol described in U.S. Pat. Nos. 3,351,286, 3,761,270, 3,764,328, 3,342,599 and 3,719,492, Research Disclosure Nos. 12,146, 15,108 and 15,127 and Japanese Patent O.P.I. Publication Nos. 27132/1981, 135628/1978 and 79035/1982, developing agents based on amidophenol phosphate, developing agents based on sulfonamidoaniline, hydrazone-based developing agents, phenols, sulfonamidophenols, polyhydroxybenzenes, naphthols, hydroxybisnaphthyls, methylenebisphenols, ascorbic acids, 1-aryl-3-pyrazolidones, hydrazones and precursors thereof.

Dye-providing materials may serve as reducing agents concurrently.

The particularly preferred reducing agents are the N-(p-N',N'-dialkylamino)phenylsulfamate and derivatives thereof described in Japanese Patent O.P.I. Publication Nos. 146133/1981 and 227141/1987, specifically the compounds described on line 6, lower left column, page 7, through lower right column, page 8, of Japanese Patent O.P.I. Publication No. 863/1990.

The heat-processable light-sensitive material of the present invention may incorporate a thermal solvent for promoting dye transfer and other purposes. The thermal solvent is a compound which liquifies upon thermal development and acts to accelerate thermal development and thermal transfer of the dye. It is preferably in a solid state at normal temperature.

Examples of thermal solvents which can be used for the present invention include the compounds described in U.S. Pat. Nos. 3,347,675, 3,667,959, 3,438,776 and 3,666,477, Research Disclosure No. 17,643 and Japanese Patent O.P.I. Publication Nos. 19525/1976, 24829/1978, 60223/1978, 118640/1983, 198038/1983, 229556/1984, 68730/1984, 84236/1984, 191251/1985, 232547/1985, 14241/1985, 52643/1986, 78554/1987, 42153/1987, 44737/1987, 53548/1988, 161446/1988, 224751/1989, 863/1990, 120739/1990 and 123354/1990.

Specifically, urea and derivatives thereof such as dimethyl urea and phenyl urea, amide derivatives such as acetamide, stearylamide, p-toluamide and p-propanoyloxyethoxybenzamide, sulfonamide derivatives such as p-toluenesulfonamide and polyhydric alcohols such as 1,6-hexanediol, pentaerythritol and polyethylene glycol are preferably used.

The thermal solvent above can be added to any of light-sensitive silver halide emulsion layers, intermediate layers, protective layers and image-receiving layers, and the amount of addition thereof is normally 10 to 500% by weight, preferably 20 to 200% by weight relative to the amount of the binder.

The binder preferably used in the heat-processable light-sensitive material of the present invention is the binder described on line 14, upper right column, through line 10, lower left column, of page 10 of Japanese Patent O.P.I. Publication No. 863/1990, with greater preference given to gelatin and polyvinylpyrrolidone and a combination thereof.

In addition to the above-mentioned additives, the heat-processable light-sensitive material of the present invention can incorporate various additives as necessary.

The developing-accelerator-releasing compounds described in Japanese Patent O.P.I. Publication Nos. 177550/1984, 111636/1984, 124333/1984, 72233/1986, 236548/1986, 152454/1989, 159642/1986 and 104645/1989 and Japanese Patent Application No. 110767/1989 and the metal ion described in Japanese Patent O.P.I. Publication No. 104645/1989, which is not less than 4 in electrical negativity, can also be used as developing accelerators.

Example antifogging agents include the higher fatty acids described n U.S. Pat. No. 3,645,739, the secondary mercury salts described in Japanese Patent Examined Publication No. 11113/1972, the N-halides described in Japanese Patent O.P.I. Publication No. 47419/1976, the mercapto-releasing compounds described in U.S. Pat. No. 3,700,457, Japanese Patent O.P.I. Publication No.

50725/1976 and Japanese Patent Application Nos. 69994/1989 and 104271/1989, the arylsulfonic acids described in Japanese Patent O.P.I. Publication No. 125016/1974, the lithium carboxylates described in Japanese Patent O.P.I. Publication No. 47419/1976, the oxidants described in British Patent No. 1,455,271 and Japanese Patent O.P.I. Publication No. 101019/1975, the sulfinic acids and thiosulfonic acids described in Japanese Patent O.P.I. Publication No. 19825/1978, the thiouracils described in Japanese Patent O.P.I. Publication No. 3223/1976, the sulfur compounds described in Japanese Patent O.P.I. Publication No. 26019/1976, the disulfides and polysulfides described in Japanese Patent O.P.I. Publication Nos. 42529/1976, 81124/1976 and 93149/1980, the rosins or diterpens described in Japanese Patent O.P.I. Publication No. 57435/1976, the polymer acids described in Japanese Patent O.P.I. Publication No. 104338/1976, which have a carboxyl group or a sulfonate group, the thiazolithiones described in U.S. Pat. No. 4,138,265, the triazoles described in Japanese Patent O.P.I. Publication Nos. 51821/1979 and 142,331/1980 and U.S. Pat. No. 4,137,079, the thiosulfinates described in Japanese Patent O.P.I. Publication No. 140883/1980, the di- or tri-halides described in Japanese Patent O.P.I. Publication Nos. 46641/1984, 57233/1984 and 57234/1984, the thiol compounds described in Japanese Patent O.P.I. Publication No. 111636/1984, the hydroquinone derivatives described in Japanese Patent O.P.I. Publication No. 198540/1985 and 227255/1985, the antifogging agents described in Japanese Patent O.P.I. Publication No. 78554/1987, which have a hydrophilic group, the polymeric antifogging agents described in Japanese Patent O.P.I. Publication No. 121452/1987, the antifogging agents described in Japanese Patent O.P.I. Publication No. 123456/1987, which have a ballast group, and the non-color-forming couplers described in Japanese Patent O.P.I. Publication No. 161239/1989.

Example base precursors include the base-releasing compounds described in Japanese Patent O.P.I. Publication Nos. 130745/1981, 157637/1984, 166943/1984, 180537/1984, 174830/1984, 195237/1984, 108249/1987, 174745/1987, 187847/1987, 97942/1988, 96159/1988 and 68746/1989.

In addition to the above-mentioned additives, various known photographic additives can be used in the heat-processable light-sensitive material of the present invention, including anti-halation dyes, anti-irradiation dyes, colloidal silver, brightening agents, hardeners, antistatic agents, surfactants, inorganic and organic matting agents, anti-fading agents, ultraviolet absorbents, antifungal agents, white background toning agents, and pollutant-adsorbing fine solid particles of activated charcoal.

These additives can be added to any appropriate photographic layer such as intermediate layers, subbing layers, protective layers and backing layers as well as light-sensitive layers.

The support for the heat-processable light-sensitive material of the present invention may be the support described on line 15, upper left column, through line 1, upper right column, page 12 of Japanese Patent O.P.I. Publication No. 863/1990 Preferably, a polyethylene terephthalate support or a paper support such as of cast coat paper or baryta paper is used.

The image-receiving material used in combination with the heat-processable light-sensitive material of the present invention comprises a support and an image-receiving layer formed thereon capable of receiving dyes. The support itself may serve as such an image-receiving layer capable of receiving dyes.

There are roughly two types of image-receiving layer: the binder itself is capable of receiving dyes and that in which a mordant capable of receiving dyes is contained in the binder.

The binder capable of receiving dyes is preferably a polymer binder having a glass transition point of about 40° C. to about 250° C. Specifically, the synthetic polymer described in Polymer Handbook, 2nd edition, edited by J. Brandrup and E. H. Immergut, John Wiley & Sons, which has a glass transition point of over 40° C., is useful. Usually, polymers having a molecular weight of about 2000 to 200000 are useful. These polymers may be used singly or in combination, and may be copolymerizable polymers having two or more kinds of repeat unit.

Specifically, the polymer described on line 14, upper left column, through line 14, upper right column, page 14 of Japanese Patent O.P.I. Publication No. 863/1990 can be used preferably.

With respect to the image-receiving material wherein a mordant-containing binder is present in the image-receiving layer, the mordant is preferably a polymer containing a tertiary amine or a quaternary ammonium salt, including the compounds described in U.S. Pat. No. 3,709,690 and Japanese Patent O.P.I. Publication No. 13546/1989. The binder used to retain such a mordant is preferably a hydrophilic binder such as gelatin or polyvinyl alcohol.

The dye-receiving layer comprising a hydrophobic polymer latex capable of receiving dyes, dispersed in a hydrophilic binder, like the image-receiving layer wherein such a mordant is present in the binder, can also be used for the present invention.

The image-receiving material of the present invention may have a configuration wherein a single image-receiving layer is formed on a support or a plurality of structural layers may be coated, whether all or part of said structural layers are dye-receiving materials.

The image-receiving material of the present invention can incorporate various known additives, including antistaining agents, ultraviolet absorbents, brightening agents, image stabilizers, developing accelerators, antifogging agents, pH regulators such as acids, acid precursors and base precursors, thermal solvents, organic fluorine compounds, oil drops, surfactants, hardeners, matting agents and various metal ions.

The heat-processable light-sensitive material of the present invention can be subjected to exposure by a known means suitable for the spectral sensitivity of light-sensitive material.

An exposure light source which can be used is described on lines 13 through 16, lower left column, page 12 of Japanese Patent O.P.I. Publication No. 863/1990. Laser light sources, CRT light sources and LED are preferably used. Semiconductor laser and SHG elements (secondary high frequency generating elements) can also be used. The heat-processable light-sensitive material of the present invention is thermally developed at 70° to 200° C., more preferably 90° to 170° C. for 1 to 180 seconds, more preferably 2 to 120 seconds after or simultaneously with imagewise exposure to form a dye image. Diffusible dye transfer to the image-receiving material may be conducted simultaneously with heat development by bringing the image-receiving layer surface of the image-receiving material in contact with the light-sensitive layer side at the time of heat development, or may be conducted by bringing the image-receiving material in contact with the light-sensitive material after heat development. It is also acceptable to bring the light-sensitive material and the image-receiving material in contact with each other after supplying water. It is also possible to preliminarily heat the light-sensitive material in the temperature range of 70° to 160° C. before exposure, or to preliminarily heat at least one of the light-sensitive material and the image-receiving material in the temperature range of 80° to 120° C. immediately before development, as described in Japanese Patent O.P.I. Publication Nos. 143338/1985 and 162041/1986.

In thermally processing the heat-processable light-sensitive material of the present invention, known heating means are applicable, including the method described on lines 12 through 19, in the upper left column, on page 13 of Japanese Patent O.P.I. Publication No. 863/1990 and the method based on far infrared heating.

EXAMPLES

The present invention is hereinafter described in more detail by means of the following examples, which are not to be construed as limitative on the embodiment of the invention.

EXAMPLE 1

Preparation of Heat-Processable Light-Sensitive Material

Heat-processable light-sensitive material sample No. 1 comprising a sheet of photographic baryta paper of 160 μm thickness and the following structural compositions formed thereon was prepared.

Figures for the amount of addition are expressed per $m^2$ of heat-processable light-sensitive material.

Figures for light-sensitive silver halide emulsions and organic silver salts are based on the amount of silver (the same applies to all the following additives).

Layer compositions of heat-processable light-sensitive material No. 1

| | |
|---|---|
| Subbing layer | |
| Polyphenylene ether | 2.0 g |
| Polystyrene | 2.0 g |
| Example Compound 1-1 | 0.4 g |
| Layer 1: Red-sensitive layer | |
| Benzotriazole silver | 1.6 g |
| Polybutylacrylate BA | 0.4 g |
| Dye-providing material 3 | 1.2 g |
| DAP | 0.11 g |
| Red-sensitive silver halide emulsion | 0.68 g (Ag) |
| Gelatin | 1.5 g |
| Polyvinylpyrrolidone K-30 | 0.6 g |
| Hot solvent A | 4.5 g |
| Anti-irradiation dye 2 | 0.01 g |
| FR-1 (potassium bromide) | 0.005 g |
| Layer 2: First interlayer | |
| Gelatin | 0.8 g |
| Reducing agent | 1.12 g |
| Layer 3: Green-sensitive layer | |
| Benzotriazole silver | 0.8 g |
| BA | 0.4 g |
| Dye-providing material 2 | 0.9 g |
| DAP | 0.03 g |
| Green-sensitive silver halide emulsion | 0.47 g (Ag) |
| Gelatin | 2.0 g |
| PVP K-30 | 0.3 g |
| Hot solvent A | 3.45 g |
| Anti-irradiation dye | 0.02 g |
| FR-1 | 0.003 g |

-continued

Layer compositions of heat-processable light-sensitive material No. 1

| | |
|---|---|
| Layer 4: Second intermediate layer | |
| Gelatin | 1.55 g |
| Reducing agent | 1.5 g |
| UV absorbent 1 | 0.3 g |
| DIDP diisodecyl phthalate | 0.22 g |
| Yellow filter dye | 0.26 g |
| Layer 5: Blue-sensitive layer | |
| Benzotriazole silver | 1.5 g |
| BA | 0.344 g |
| Dye-providing material 1 | 1.2 g |
| Blue-sensitive silver halide emulsion | 0.45 g (Ag) |
| Gelatin | 1.6 g |
| PVP K-30 | 0.4 g |
| Hot solvent A | 4.0 g |
| FR-1 | 0.002 g |
| DAP | 0.02 g |
| Layer 6: Protective layer | |
| Gelatin | 1.0 g |
| Polyvinylpyrrolidone K-30 | 0.2 g |
| $ZnSO_4$ | 0.65 g |
| Reducing agent | 0.34 g |
| DIDP | 0.2 g |
| DAP | 0.1 g |
| UV absorbent 1 | 0.4 g |

Figures for the amount of addition are per $m^2$. Each layer contained 0.03 g of bisvinylsulfonylmethyl ether per gram of gelatin, as a hardener, and surfactant 1 necessary for coating. The reducing agent was a mixture of reducing agents 1 and 2 in a ratio of 7 to 3 by weight.

The structural formulas of the additives used in the light-sensitive layers of the heat-processable light-sensitive material are as follows:

Dye-providing material 1

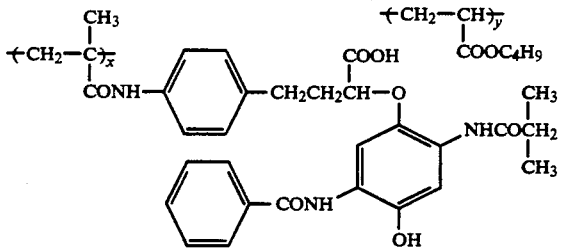

x = 60% by weight
y = 40% by weight

Dye p-providing material 2

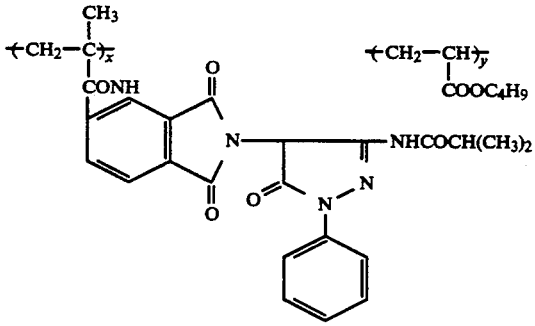

x = 50% by weight
y = 50% by weight

Dye-providing material 3

-continued

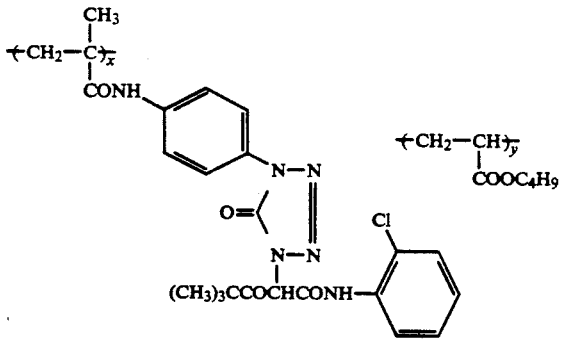

x = 70% by weight
y = 30% by weight

Reducing agent 1

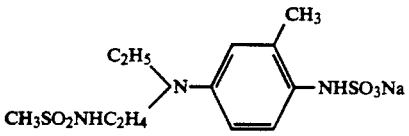

Reducing agent 2

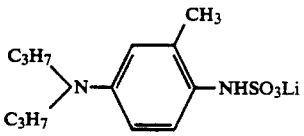

Hot solvent A

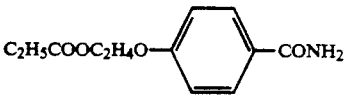

Anti-irradiation dye 1

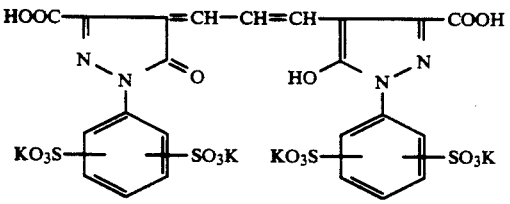

Anti-irradiation dye 2

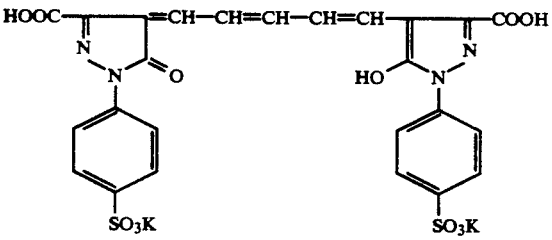

DAP

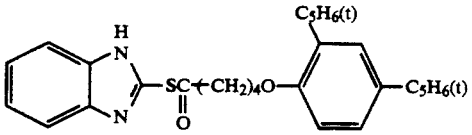

-continued

Ultraviolet absorbent 1

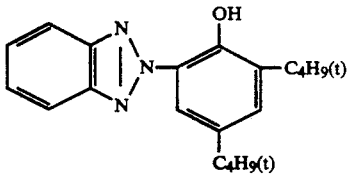

Yellow filter dye 1

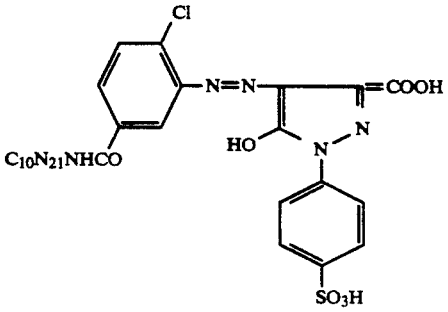

Surfactant 1

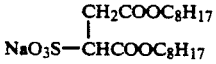

Benzotriazole Silver Emulsion

To a 10% aqueous solution of phenylcarbamoyl gelatin, kept at 50° C., an ammoniacal aqueous solution of silver nitrate and benzotriazole (containing 0.2 mol aqueous ammonia per mol of benzotriazole) were simultaneously added. After completion of the addition, the pH was lowered, followed by coagulation and desalinization, to obtain a needle (0.1 to 0.2 μm width, 0.5 to 2 μm length).

A stabilizer ST-2 was added at 20 mg per mol of benzotriazole silver.

The light-sensitive silver halide emulsions (AgClBr) used are as follows:

| Item | Blue-sensitive emulsion | Green-sensitive emulsion (GEM-1) | Red-sensitive emulsion |
|---|---|---|---|
| Silver halide composition (Br mol %) | 70 | 60 | 70 |
| Grain shape | Hexagonal | Cubic | Cubic |
| Average grain size *1 | 0.30 μm | 0.19 μm | 0.20 μm |
| Grain size distribution coefficient *2 | 0.15 | 0.17 | 0.13 |
| Method of surface chemical sensitization *3 | S + Au | S | S + Au |
| Stabilizer | ST-1 | ST-1 | ST-2 |

-continued

| Item | Blue-sensitive emulsion | Green-sensitive emulsion (GEM-1) | Red-sensitive emulsion |
|---|---|---|---|
| Sensitizing dye | BSD-1 | CSD-1 | RSD-1 |

*1: Diameter of converted sphere
*2: Grain size distribution coefficient = grain size standard deviation /average grain size
*3:
S + Au: Gold-sulfur sensitization with sodium thiosulfate and potassium chloroaurate
S: Sulfur sensitization with sodium thiosulfate
The above light-sensitive silver halide emulsions were supplemented with iridium (IV) sodium hexachloride at $10^{-6}$ mol per mol of silver halide at grain formation.
ST-1: 5-methyl-1,3,3a,7-tetrazaindene Each chemical sensitization was conducted in the presence of one of the following sensitizing dyes.

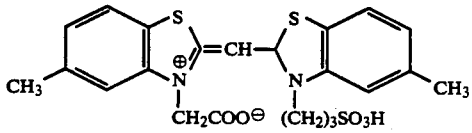

BSD-1

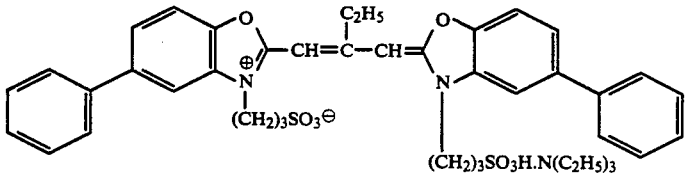

GSD-1

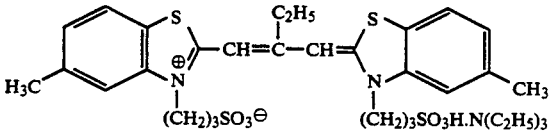

RSD-1

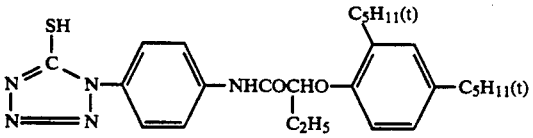

ST-2

The dye-providing material was prepared by mixing the following solutions I and II, emulsifying and dispersing the mixture in a high speed homo-mixer, subsequently evaporating off the ethyl acetate under reduced pressure and adding pure water up to the volume shown below.

TABLE 1

| | | Layer 1 | Layer 3 | Layer 5 |
|---|---|---|---|---|
| Solution I | Dye-providing material | 12 g | 9 g | 12 g |
| Solution I | BA | 4.0 g | 4.0 g | 3.44 g |
| | DAP | 1.1 g | 0.3 g | 0.2 g |
| | Ethyl acetate | 45 cc | 46 cc | 49 cc |
| Solution II | Gelatin | 16 g | 6 g | 6 g |
| | Pure water | 120 cc | 120 cc | 120 cc |
| | Activator* | 0.8 g | 0.8 g | 0.8 g |
| Finished volume | | 200 cc | 200 cc | 200 cc |

Activator*: Sodium triisopropylnaphthalenesulfonate

Next, heat-processable light-sensitive material Nos. 2 through 16 were prepared in the same manner as with heat-processable light-sensitive material sample No. 1 except that a compound of the present invention and a comparative alkyl group were added to solution I in dispersing the above dispersion of dye-providing material to obtain a dye-providing material dispersion.

Figures for the amount of addition of the compound of the present invention are expressed per $m^2$ of heat-processable light-sensitive material.

Preparation of Image-Receiving Material

An image-receiving layer of the following composition was formed on the same photographic baryta paper support as used to prepare the heat-processable light-sensitive materials, to obtain image-receiving material sample No. 1 (figures for the amount of addition are expressed per $m^2$ of image-receiving material).

| | |
|---|---|
| Polyvinyl chloride (average degree of polymerization 500) | 10 g |
| Image stabilizer 1 | 1.1 g |
| Image stabilizer 2 | 0.3 g |
| Image stabilizer 3 | 0.5 g |
| Image stabilizer 4 | 0.3 g |
| Hot solvent B | 4.2 g |

The above composition was dissolved in methyl ethyl ketone to obtain a coating solution, which was coated on the support.

Image stabilizer 1

-continued

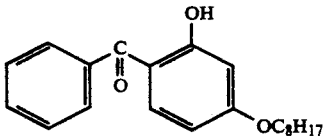

Image stabilizer 2

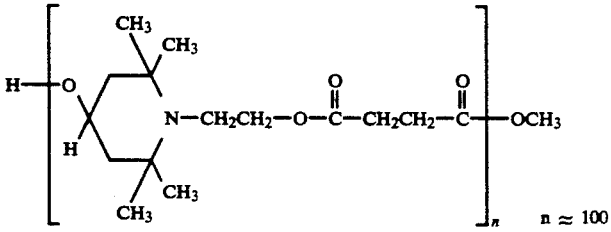

Image stabilizer 3

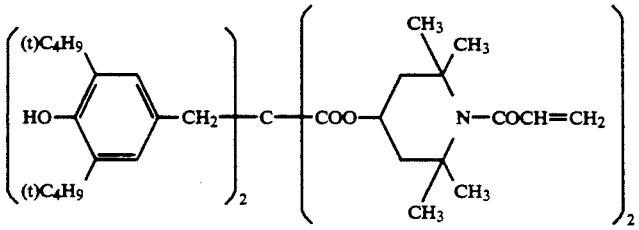

Image stabilizer 4

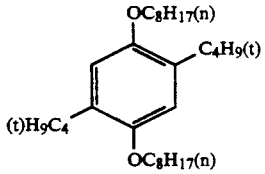

Hot solvent B

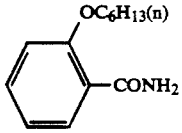

The obtained heat-processable light-sensitive material was hardened by 2-day storage at 40° C. and 60% relative humidity, after which it was subjected to exposure through an optical wedge and developed by heating at 150° C. for 60 seconds. Then, it was superposed on the above image receiving material sample No. 1 and heated at 130° C. for 20 seconds to cause dye transfer.

The image-receiving material was subjected to densitometry for dye image reflective density with light of a simple blue, green or red spectrum to determine $D_{min}$, $D_{max}$ and contrast (contrast for reflective densities between 0.5 and 1.5). The results are given in Table 2.

TABLE 2

| Heat-processable light-sensitive material | Compound | | | | | | Dmin | | | Dmax | | | Contrast | | |
|---|---|---|---|---|---|---|---|---|---|---|---|---|---|---|---|
| | Layer 1 | | Layer 3 | | Layer 5 | | B | G | R | B | G | R | B | G | R |
| 1 (comparative) | — | | — | | — | | 0.19 | 0.16 | 0.12 | 1.87 | 2.01 | 2.11 | 1.56 | 1.48 | 1.62 |
| 2 (inventive) | 3-6 | 0.2 | 3-6 | 0.2 | 3-6 | 0.2 | 0.12 | 0.11 | 0.08 | 2.02 | 2.21 | 2.31 | 2.15 | 2.12 | 2.01 |
| 3 (inventive) | 3-7 | 0.2 | 3-7 | 0.2 | 3-7 | 0.2 | 0.07 | 0.06 | 0.03 | 2.11 | 2.35 | 2.51 | 2.56 | 2.48 | 2.60 |
| 4 (inventive) | 3-11 | 0.2 | 3-11 | 0.2 | 3-11 | 0.2 | 0.11 | 0.12 | 0.09 | 2.01 | 2.16 | 2.26 | 2.15 | 2.07 | 1.89 |
| 5 (inventive) | 3-14 | 0.2 | 3-14 | 0.2 | 3-14 | 0.2 | 0.08 | 0.08 | 0.05 | 2.16 | 2.38 | 2.55 | 2.47 | 2.61 | 2.55 |
| 6 (inventive) | 3-17 | 0.2 | 3-17 | 0.2 | 3-17 | 0.2 | 0.10 | 0.11 | 0.09 | 2.05 | 2.16 | 2.34 | 2.27 | 2.21 | 2.08 |
| 7 (inventive) | 4-1 | 0.2 | 4-1 | 0.2 | 4-1 | 0.2 | 0.09 | 0.10 | 0.09 | 1.92 | 2.12 | 2.20 | 1.77 | 1.69 | 1.98 |
| 8 (inventive) | 4-7 | 0.2 | 4-7 | 0.2 | 4-7 | 0.2 | 0.08 | 0.09 | 0.08 | 1.95 | 2.10 | 2.22 | 1.84 | 1.72 | 1.90 |
| 9 (inventive) | 4-15 | 0.2 | 4-15 | 0.2 | 4-15 | 0.2 | 0.08 | 0.07 | 0.08 | 2.00 | 2.11 | 2.24 | 1.80 | 1.73 | 1.91 |
| 10 (inventive) | 3-7 | 0.05 | 3-7 | 0.05 | 3-7 | 0.05 | 0.12 | 0.10 | 0.06 | 1.92 | 1.98 | 2.16 | 2.29 | 2.19 | 2.36 |
| 11 (inventive) | 3-7 | 0.1 | 3-7 | 0.1 | 3-7 | 0.1 | 0.09 | 0.08 | 0.04 | 2.01 | 2.18 | 2.26 | 2.31 | 2.36 | 2.40 |

TABLE 2-continued

| Heat-processable light-sensitive material | Compound Layer 1 | | Compound Layer 3 | | Compound Layer 5 | | Dmin B | Dmin G | Dmin R | Dmax B | Dmax G | Dmax R | Contrast B | Contrast G | Contrast R |
|---|---|---|---|---|---|---|---|---|---|---|---|---|---|---|---|
| 12 (inventive) | 3-7 | 0.3 | 3-7 | 0.3 | 3-7 | 0.3 | 0.06 | 0.05 | 0.02 | 2.08 | 2.24 | 2.33 | 2.76 | 2.45 | 2.76 |
| 13 (comparative) | 1-1 | 0.2 | 1-1 | 0.2 | 1-1 | 0.2 | 0.18 | 0.14 | 0.11 | 1.84 | 1.91 | 1.92 | 1.49 | 1.53 | 1.50 |
| 14 (comparative) | 1-2 | 0.2 | 1-2 | 0.2 | 1-2 | 0.2 | 0.18 | 0.15 | 0.11 | 1.82 | 1.96 | 2.01 | 1.63 | 1.52 | 1.61 |
| 15 (comparative) | 2-1 | 0.2 | 2-1 | 0.2 | 2-1 | 0.2 | 0.17 | 0.14 | 0.11 | 1.83 | 1.97 | 2.01 | 1.61 | 1.63 | 1.70 |
| 16 (comparative) | 2-2 | 0.2 | 2-2 | 0.2 | 2-2 | 0.2 | 0.16 | 0.14 | 0.11 | 1.83 | 2.01 | 2.22 | 1.52 | 1.57 | 1.66 |

The results shown in Table 2 demonstrate that heat-processable light-sensitive material sample Nos. 2 through 12, all of which were prepared by emulsion dispersion of the compound of the present invention represented by formula 3 or 4, together with a dye-providing material, in layers 1, 3 and 5 (the compound represented by formula 1 was added to the subbing layer), offered suppressed $D_{min}$, increased $D_{max}$ and increased contrast, in comparison with heat-processable light-sensitive material sample No. 1, to which the compounds of the present invention were not added.

In particular, the heat-processable light-sensitive materials prepared with the compound of the present invention represented by formula 3 showed a marked effect, with better results obtained from heat-processable light-sensitive material sample Nos. 3, 5 and 10 through 12, all of which incorporated the compound of the present invention represented by formula 3 and having an iodine atom.

COMPARATIVE EXAMPLE 1

Heat-processable light-sensitive material sample Nos. 1b through 9b, 13b and 14 b were prepared in the same manner as in Example 1 except that Example Compound I-1 was not added to the subbing layer, followed by exposure and heat development and dye transfer in the same manner as in Example 1. The results are shown in Table 3.

TABLE 3

| Heat-processable light-sensitive material | Compound | Dmin B | Dmin G | Dmin R | DMax B | DMax G | DMax R | Contrast B | Contrast G | Contrast R |
|---|---|---|---|---|---|---|---|---|---|---|
| 1b | — | 0.31 | 0.30 | 0.21 | 1.76 | 1.91 | 1.96 | 1.24 | 1.37 | 1.49 |
| 2b | 3-6 | 0.21 | 0.24 | 0.14 | 1.72 | 1.89 | 196 | 1.31 | 1.42 | 1.50 |
| 3b | 3-7 | 0.20 | 0.21 | 0.13 | 1.70 | 1.94 | 1.99 | 1.40 | 1.49 | 1.61 |
| 4b | 3-11 | 0.22 | 0.20 | 0.11 | 1.81 | 1.95 | 1.96 | 1.40 | 1.62 | 1.70 |
| 5b | 3-14 | 0.21 | 0.19 | 0.14 | 1.84 | 2.03 | 2.06 | 1.50 | 1.61 | 1.73 |
| 6b | 3-17 | 0.23 | 0.20 | 0.13 | 1.76 | 1.96 | 1.95 | 1.49 | 1.51 | 1.61 |
| 7b | 4-1 | 0.22 | 0.19 | 0.12 | 1.62 | 1.99 | 1.86 | 1.52 | 1.49 | 1.37 |
| 8b | 4-7 | 0.24 | 0.20 | 0.12 | 1.66 | 2.01 | 1.94 | 1.50 | 1.42 | 1.39 |
| 9b | 4-15 | 0.27 | 0.19 | 0.10 | 1.73 | 1.86 | 1.97 | 1.40 | 1.47 | 1.31 |
| 13b | 1-1 | 0.18 | 0.17 | 0.09 | 1.60 | 1.89 | 1.90 | 1.39 | 1.31 | 1.30 |
| 14b | 1-2 | 0.16 | 0.15 | 0.09 | 1.71 | 1.93 | 1.99 | 1.20 | 1.36 | 1.37 |

The results given in Table 3 demonstrate that when a heat-processable light-sensitive material free of the compound represented by formula 1 or 2 is used, the inhibitory effect on $D_{min}$ is insufficient and no marked contrast improving effect is obtained even in the presence of the compound represented by formula 3 or 4.

EXAMPLE 2

Heat-processable light-sensitive material sample Nos. 1C, 3C, 5C, 7C and 13C were prepared in the same manner as heat-processable light-sensitive material sample Nos. 1, 3, 5, 7 and 13 except that the compound in the subbing layer was replaced with 2-2 (amount of addition 0.4 g/m$^2$). The procedures of Example 1 were repeated and the results shown in Table 4 were obtained.

TABLE 4

| Heat-processable light-sensitive material | Compound | Dmin B | Dmin G | Dmin R | DMax B | DMax G | DMax R | Contrast B | Contrast G | Contrast R |
|---|---|---|---|---|---|---|---|---|---|---|
| 1C | — | 0.24 | 0.20 | 0.13 | 1.93 | 2.11 | 2.24 | 1.63 | 1.59 | 1.69 |
| 3C | 3-7 | 0.08 | 0.06 | 0.04 | 2.14 | 2.31 | 2.46 | 2.41 | 2.39 | 2.42 |
| 5C | 3-14 | 0.09 | 0.08 | 0.05 | 2.11 | 2.27 | 2.39 | 2.31 | 2.32 | 2.37 |
| 7C | 4-1 | 0.12 | 0.10 | 0.06 | 2.01 | 2.24 | 2.30 | 2.00 | 2.14 | 2.11 |
| 13C | 1-1 | 0.22 | 0.14 | 0.10 | 1.86 | 2.03 | 2.19 | 1.57 | 1.49 | 1.51 |

The results given in Table 4 demonstrate that the heat-processable light-sensitive material sample Nos. 3C, 5C and 7C all offered low values of $D_{min}$ and high values of $D_{max}$ and high contrast as in Example 1 wherein the compound represented by formula 2 was added to the subbing layer and the compound represented by formula 3 or 4 to the emulsion layer.

EXAMPLE 3

Heat-processable light-sensitive material sample Nos. 1 through 5 and 7 used in Example 1 were processed in the same manner as in Example 1 except that the heat-processable light-sensitive material and image-receiving material 1 were superposed and subjected to heat development and dye transfer simultaneously at 150° C. for 70 seconds. The results are given in Table 5.

TABLE 5

| Heat-processable light-sensitive material | Compound Layer 1 | | Layer 3 | | Layer 5 | | Dmin B | G | R | Dmax B | G | R | Contrast B | G | R |
|---|---|---|---|---|---|---|---|---|---|---|---|---|---|---|---|
| 1 | — | | — | | — | | 0.28 | 0.24 | 0.18 | 2.21 | 2.25 | 2.31 | 1.98 | 1.92 | 2.21 |
| 2 | 3-6 | 0.2 | 3-6 | 0.2 | 3-6 | 0.2 | 0.19 | 0.16 | 0.12 | 2.28 | 2.37 | 2.49 | 2.25 | 2.21 | 2.30 |
| 3 | 3-7 | 0.2 | 3-7 | 0.2 | 3-7 | 0.2 | 0.14 | 0.12 | 0.09 | 2.36 | 2.40 | 2.66 | 2.47 | 2.30 | 2.41 |
| 4 | 3-11 | 0.2 | 3-11 | 0.2 | 3-11 | 0.2 | 0.15 | 0.14 | 0.09 | 2.22 | 2.30 | 2.48 | 2.24 | 2.19 | 2.15 |
| 5 | 3-14 | 0.2 | 3-14 | 0.2 | 3-14 | 0.2 | 0.13 | 0.13 | 0.10 | 2.26 | 2.46 | 2.65 | 2.49 | 2.36 | 2.45 |
| 7 | 4-1 | 0.2 | 4-1 | 0.2 | 4-1 | 0.2 | 0.17 | 0.14 | 0.10 | 2.28 | 2.32 | 2.40 | 1.97 | 2.11 | 2.37 |

The results given in Table 5 demonstrate that although the heat-processable light-sensitive materials incorporating the compound of the present invention offered an effect similar to that obtained in Example 1, the effectiveness was lower than that obtained when heat development and dye transfer were conducted separately.

EXAMPLE 4

Image-receiving material sample No. 2 was prepared in the same manner as in Example 1 except that Example Compound 1-1 represented by formula 1 was added to the image-receiving layer at 0.4 g/m$^2$.

Image-receiving material sample No. 2, in combination with heat-processable light-sensitive material sample Nos. 1b through 9b, 13b and 14b prepared in Comparative Example 1, was subjected to exposure, heat development and dye transfer in the same manner as in Comparative Example 1. The results are given in Table 6.

TABLE 6

| Heat-processable light-sensitive material | Compound | Dmin B | G | R | DMax B | G | R | Contrast B | G | R |
|---|---|---|---|---|---|---|---|---|---|---|
| 1b | — | 0.25 | 0.21 | 0.14 | 1.75 | 1.89 | 2.03 | 1.37 | 1.51 | 1.47 |
| 2b | 3-6 | 0.17 | 0.14 | 0.10 | 1.73 | 1.83 | 1.94 | 1.61 | 1.74 | 1.68 |
| 3b | 3-7 | 0.16 | 0.12 | 0.08 | 1.77 | 1.90 | 1.95 | 1.77 | 1.91 | 2.03 |
| 4b | 3-11 | 0.18 | 0.14 | 0.10 | 1.81 | 1.92 | 1.96 | 1.63 | 1.77 | 1.70 |
| 5b | 3-14 | 0.16 | 0.12 | 0.09 | 1.77 | 1.85 | 1.96 | 1.81 | 1.96 | 2.11 |
| 6b | 3-17 | 0.18 | 0.14 | 0.10 | 1.84 | 1.89 | 1.95 | 1.66 | 1.69 | 1.81 |
| 7b | 4-1 | 0.17 | 0.13 | 0.11 | 1.79 | 1.90 | 2.02 | 1.54 | 1.71 | 1.90 |
| 8b | 4-7 | 0.18 | 0.12 | 0.10 | 1.72 | 1.88 | 2.01 | 1.50 | 1.71 | 1.84 |
| 9b | 4-15 | 0.17 | 0.13 | 0.11 | 1.74 | 1.90 | 1.98 | 1.53 | 1.69 | 1.81 |
| 13b | 1-1 | 0.18 | 0.15 | 0.12 | 1.76 | 1.84 | 1.91 | 1.21 | 1.42 | 1.38 |
| 14b | 1-2 | 0.17 | 0.14 | 0.11 | 1.77 | 1.81 | 1.96 | 1.31 | 1.47 | 1.21 |

The results shown in Table 6 demonstrate that even when the compound represented by formula 3 or 4 was added to the heat-processable light-sensitive material and the compound of formula 1 was added to the image-receiving material, effects of the present invention, particularly suppression of $D_{min}$ and high contrast, can be obtained. However, in the process wherein the compound represented by formula 1 was added to the image-receiving material and heat development and dye transfer were conducted separately, the obtained effect is not likely to be as marked as obtained in Example 1.

EXAMPLE 5

The procedure of Example 4 was repeated, but this time heat development and dye transfer were conducted simultaneously. After exposure, the heat-processable light-sensitive material was superposed on dye-receiving material sample No. 2 and heated at 150° C. for 70 seconds, after which they were detached from each other. The results are given in Table 7.

TABLE 7

| Heat-processable light-sensitive material | Compound | Dmin B | G | R | DMax B | G | R | Contrast B | G | R |
|---|---|---|---|---|---|---|---|---|---|---|
| 1b | — | 0.26 | 0.24 | 0.19 | 2.41 | 2.52 | 2.61 | 2.03 | 2.31 | 2.51 |
| 2b | 3-6 | 0.18 | 0.17 | 0.12 | 2.51 | 2.59 | 2.63 | 2.49 | 2.71 | 3.14 |
| 3b | 3-7 | 0.15 | 0.13 | 0.09 | 2.52 | 2.59 | 2.70 | 2.91 | 2.95 | 3.31 |
| 4b | 3-11 | 0.17 | 0.16 | 0.11 | 2.54 | 2.57 | 2.70 | 2.61 | 2.66 | 3.14 |
| 5b | 3-14 | 0.16 | 0.15 | 0.10 | 2.56 | 2.62 | 2.69 | 2.79 | 2.96 | 3.27 |
| 6b | 3-17 | 0.18 | 0.17 | 0.12 | 2.60 | 2.59 | 2.74 | 2.57 | 2.61 | 3.17 |
| 7b | 4-1 | 0.18 | 0.17 | 0.11 | 2.56 | 2.57 | 2.68 | 2.31 | 2.57 | 2.86 |
| 8b | 4-7 | 0.18 | 0.16 | 0.10 | 2.53 | 2.60 | 2.69 | 2.37 | 2.66 | 2.99 |
| 9b | 4-15 | 0.19 | 0.17 | 0.11 | 2.55 | 2.64 | 2.67 | 2.41 | 2.55 | 2.96 |
| 13b | 1-1 | 0.22 | 0.20 | 0.15 | 2.50 | 2.47 | 2.46 | 2.04 | 2.21 | 2.39 |
| 14b | 1-2 | 0.23 | 0.19 | 0.16 | 2.49 | 2.49 | 2.52 | 2.11 | 2.27 | 2.36 |

The results given in Table 7 demonstrate that when the compound of formula 1 is added to the image-receiving material and the compound represented by formula 3 or 4 to the heat-processable light-sensitive material, an effect much higher than that obtained in Example 4 is obtained.

The present invention provides a dye image forming method wherein the maximum density hardly decreases and fogging does not increase even when the coating solution is stored for a long time in producing a heat-processable light-sensitive material or a dye-receiving material, or even when the heat-processable light sensitive material or dye-receiving material is stored at high humidity for a long time, and a transfer image with significantly improved contrast is obtained by heat development.

What is claimed is:

1. In a method for forming a dye image wherein a heat-processable light-sensitive material comprising a support having thereon a non-light-sensitive layer and a light-sensitive layer containing a light-sensitive silver halide and a dye-providing material capable of releasing and forming a diffusible dye upon heat development is imagewise exposed to light and thereafter is subjected to heat development to release or form the diffusible dye, which is transferred to a dye-receiving material having a dye-receiving layer to form a dye image on the dye-receiving layer, the improvement wherein the heat development or the transfer of the dye is carried out in the presence of a compound represented by formula 1 and a compound represented by formula 3, $(X_1)_t$—Q formula 1

$R_{31}$—$X_2$ TM formula 3 wherein $X_1$ represents a chlorine atom ; Q represents

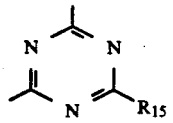

wherein $R_{15}$ represents a monovalent organic group having not less than 8 carbon atoms; t represents 2; $R_{31}$ represents an alkyl group or a cycloalkyl group; $X_2$ represents a bromine atom or an iodine atom; and wherein said compound represented by formula is contained in the non-light-sensitive layer or the dye receiving layer; and said compound represented by formula 3 has a molecular weight not less than 200 and is contained in the light-sensitive layer.

2. The method of claim 1, wherein a weight ratio of the compound represented by formula 3 to the compound represented by formula 1 is 0.02 to 50.

3. The method of claim 1 wherein the compound of formula 3 is selected from the group consisting of compounds 3-1–3-18 and 3-19 as shown below $C_{20}H_{41}Br$ 3-1

$C_{10}H_{21}Br$ 3-2

$C_{10}H_{21}I$ 3-3

$C_{16}H_{33}Br$ 3-4

$C_{16}H_{33}I$ 3-5

$C_{18}H_{37}Br$ 3-6

$C_{18}H_{37}I$ 3-7

$C_{10}H_{21}I$ 3-8

$C_{20}H_{41}I$ 3-9

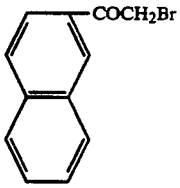

3-10

-continued

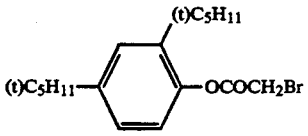

3-11

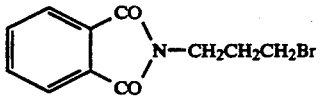

3-12

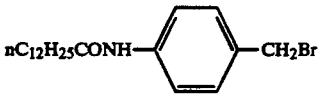

3-13

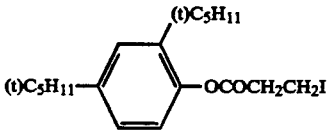

3-14

$Br(CH_2)_{10}Br$ 3-15

$Br(CH_2)_{12}Br$ 3-16

$BrCH_2CH_2COO(CH_2)_4OCOCH_2CH_2Br$ 3-17

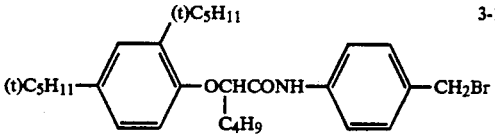

3-18

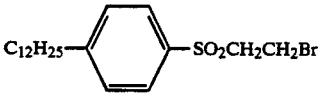

3-19

4. The method of claim 3 wherein the compound of formula 1 selected from the group consisting of compounds I-1, I-2 and I-3 shown below

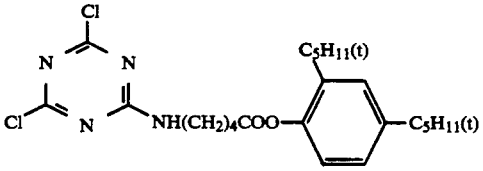

1-1

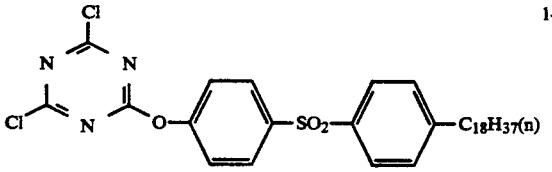

1-2

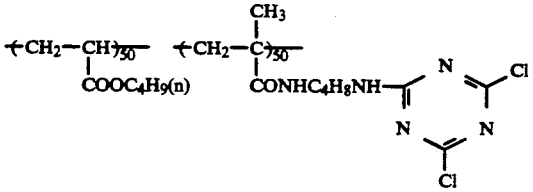

1-3

5. The method of claim 4 wherein a weight ratio of the compound of formula 3 to the compound of formula 1 is 0.02 to 50.

* * * * *